United States Patent [19]

Finn

[11] Patent Number: 4,985,991

[45] Date of Patent: Jan. 22, 1991

[54] METHOD OF MAKING A SCREW-ON ELECTRICAL CONNECTOR

[75] Inventor: Jerome W. Finn, Waterman, Ill.

[73] Assignee: Ideal Industries, Inc., Sycamore, Ill.

[21] Appl. No.: 342,097

[22] Filed: Apr. 21, 1989

[51] Int. Cl.[5] ..... H01R 43/02

[52] U.S. Cl. ..... 29/878; 29/876

[58] Field of Search ..... 29/878, 877, 876

[56] References Cited

U.S. PATENT DOCUMENTS 4,707,567 11/1987 Blaha ..... 174/87

*Primary Examiner*—Howard N. Goldberg
*Assistant Examiner*—Irene Cuda
*Attorney, Agent, or Firm*—Kinzer, Plyer, Dorn, McEachran & Jambor

[57] ABSTRACT

A screw-on electrical connector is made by a method in which the manufacturing procedure or process is greatly simplified and the resultant connector is of a high quality. The method or procedure involves bringing an insulating shell into contact with a coil which is positioned in the bore of the shell and is secured therein in one step by supplying sufficient heat to the bore of the shell to soften it and cause it to flow into an adherent relationship with the outer portions of the coil. At the same time, sufficient axial pressure is applied between the coil and the shell to cause the two to firmly interlock.

9 Claims, 1 Drawing Sheet

METHOD OF MAKING A SCREW-ON ELECTRICAL CONNECTOR

SUMMARY OF THE INVENTION

This invention is concerned with an electrical connector of the so-called screw-on type which has a plastic insulating cap or shell containing a wire coil or spring which is adapted to be screwed down on the stripped ends of two or more electric wires.

A primary object of the invention is a procedure for making such a connector which provides quality and reliability in the manufacturing process.

Another object is a method of the above type which uses simpler equipment.

Another object is a method of making connectors of the above type which reduces the cost of manufacture.

Another object is a manufacturing procedure of the above type which provides a stronger weld between the coil and shell than prior procedures.

Another object is a manufacturing procedure of the above type which saves energy.

Another object is a method of the above type which improves the quality of the resultant connectors and lowers the rejection rates relative to prior procedures.

Another object is a method or procedure of the above type which reduces the cost of the coils or springs.

Another object is a method of the above type that provides repeatability.

Another object is a method of the above type that provides controllability.

Another object is a method of the above type that is safe, quiet and presents no hazards.

Other objects will appear from time to time in the ensuing specification and drawings.

BRIEF DESCRIPTION OF THE PREFERRED EMBODIMENT

Figures 1, 2, 3, 4, 5:
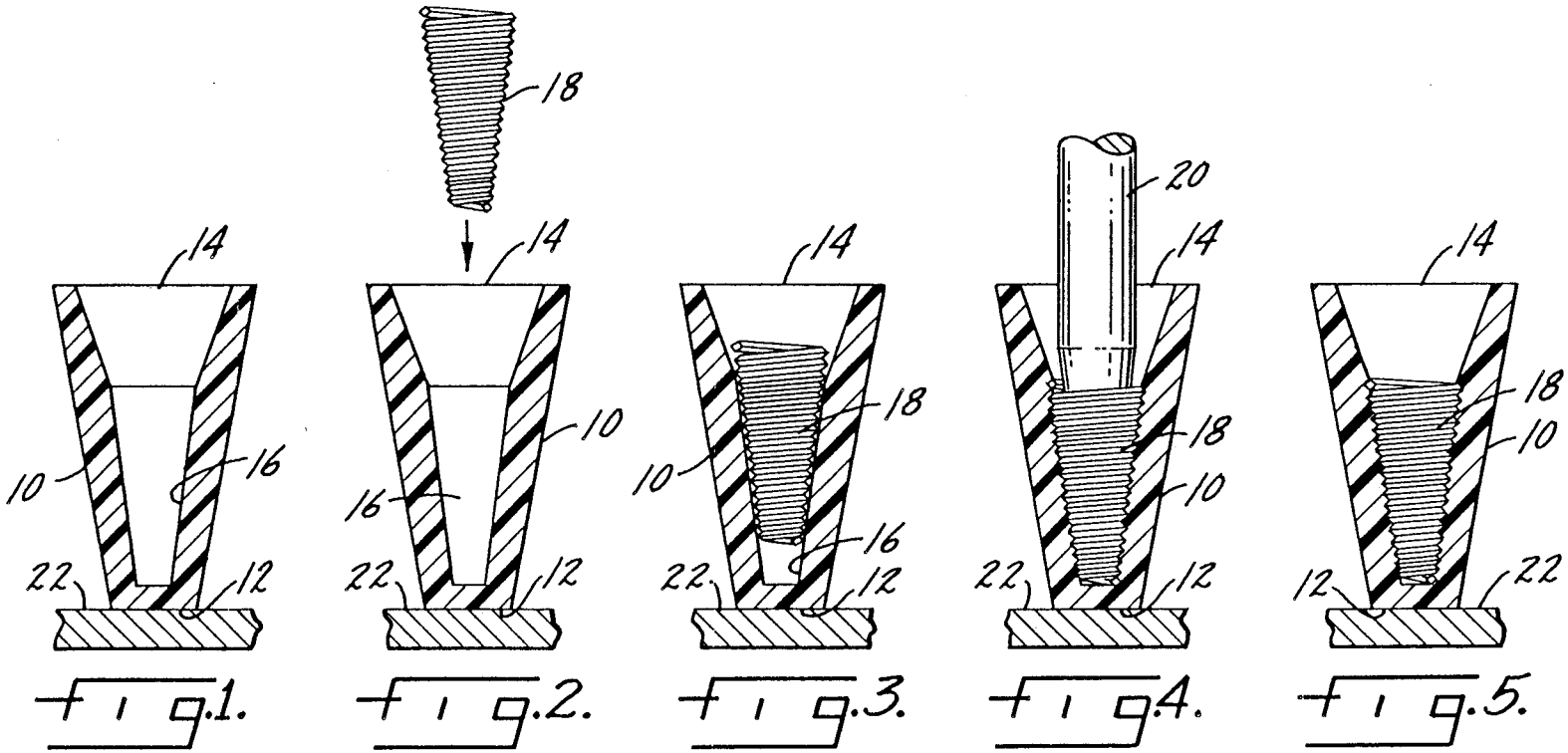
FIG. 1 is a schematic, in section, of a connector shell.
FIG. 2 is a schematic, partly in section, of a second step in the process.
FIG. 3 is a schematic, partly in section, of another step in the process.
FIG. 4 is a schematic, partly in section, of a further step in the process.
FIG. 5 is a schematic, partly in section, of a finished connector.

In FIG. 1, step 1, a connector shell or cap is shown at 10 which is upwardly truncated or tapered with an end wall or closure 12 at the small end and an opening 14 at the large end. The cap is of the conventional type for screw-on connectors and the details thereof are otherwise unimportant. The bore 16 or central cavity is constructed, arranged and dimensioned to accept a coil or spring as explained hereinafter.

In step 2, FIG. 2, the cap has been shown as positioned under a coil of wire 18 which is correspondingly tapered and, as indicated by the arrow, is dropped or lowered down into the bore of the cap. Positioning the cap with the open end up and dropping the coil in is the easiest but it might be done the other way around, i.e. the cap raised up to the coil or a combination thereof, or on a side-by-side basis, although the complication in handling equipment makes the procedure shown in FIG. 2 preferable.

In step 3, FIG. 3, the coil is resting in the bore by gravity.

In step 4, FIG. 4, an ultrasonic welder or probe 20 is inserted into the coil from above and at the same time that ultrasonic vibrations are generated in the coil, the probe also applies an axial thrust which tends to force the coil down into the bore of the cap. This supplies sufficient heat which includes applying ultrasonic vibrations between the coil and shell causing the coil to become embedded in the bore of the shell. In all of the figures so far, it will be noted that the cap is moved or moving along a suitable support 22 and the axial thrust or compression of the probe 20 is taken by the support.

The ultrasonic generator mechanically vibrates the coil. Friction between the outside of the coil and the inside of the cap generates localized heat that causes the plastic to melt, flow and fuse to the outside of the coil. An ultrasonic generator of any suitable type and size ma be used and the details are not considered important here.

The result is that the spring or coil is embedded into the plastic shell. It will be noted that the inside of the shell and the outside of the coil are tapered and the premolded hole or bore in the shell is slightly smaller than the spring. The result is that the thrust or compression plus the high frequency vibrations creates an interference fit between the metal spring and the plastic shell. When the melt occurs at the interface, the melted plastic flows into the thread of the outer diameter of the spring as it is pushed by the ultrasonic generator or probe to a set depth. It will be understood that the dimensioning is such that in the compression step in FIG. 4 the shell and coil are brought to a final predetermined relationship.

At present, an ultrasonic frequency on the order of 20 KHz is considered appropriate and will generate the localized heat that causes the plastic to melt, flow and fuse to the metal.

In the final step represented by FIG. 5, the coil and cap are removed as a finished connector and are ready for boxing, packaging, shipment, etc.

The coil may be made up of a wire that has a square cross section or it may be round or any currently used cross section.

The plastic used may be any of the thermoplastics, but it is preferred that nylon, polypropylene and/or polybutylterephthalate be used or some combination thereof.

The use, operation and function of the invention are as follows:

The invention is a method of making a screw-on electrical connector. As a result of placing a simple coil inside of a simple cap and securing it therein by a combination of an axial thrust or compression plus mechanical vibrations applied thereto of a frequency to generate sufficient heat between the coil and cap, a finished connector is formed and no special molding equipment is required. The initial form of the cap and wire coil may be of a quite simple form. Each end of the wire of the coil, the flat faces, will embed themselves sufficiently in the plastic such that when the finished connector is being turned down on the stripped ends of the wires the tip or flat face of the small end will be driven by the rotation of the cap. As well, when the connector is to be removed from the wires by reverse rotation, the tip or flat face at the large end of the wire will be embedded sufficiently in the plastic so that it will be driven, causing the coil to stay in the cap and the connector may be reused.

The amount, degree and type of ultrasonics vibration supplied and the time period thereof should be such that a firm adherence is acquired between the exterior of the coil and the interior of the cap or shell but without much, if any, plastic flowing between the turns of the coil to its inner surface which might well interfere with making a suitable connection. While the turns of the coil have been shown in contact with each other which is referred to as a closed spring, it may be open or distended somewhat so that the turns are not in contact with each other, such as shown in FIG. 5 of U.S. Pat. No. 3,110,775, issued Nov. 12, 1963. And the present invention should be considered to include such an arrangement.

The present arrangement has the advantage that heating and staking both take place at the same time which speeds up the process of manufacture. In addition, there is no possibility of overheating the coil or spring so that its metal characteristic might be changed. In fact, the degree of heating can be the exact amount needed and no more since there is no time lag between the application or generation of heat in the final positioning and staking.

While it has been stated that the taper or cone of the coil and the inside of the cap more or less match each other, it should be understood that they may be to a degree different such as shown in U.S. Pat. No. 2,825,750, issued Mar 4, 1958. The particular match or degree of contact between the two prior to heating by the ultrasonic vibrations should be such that a firm and effective interlock or adherence is provided between them.

In the cap shown and described, the interior of the bore where the coil engages it is a single taper, and it should be understood that more than one taper might be used such as in U.S. Pat. No. 2,825,750, issued Mar. 4, 1958. As well, the cap shown in the drawings may be assumed to have flutes or grooves on the exterior surface to aid in gripping and turning but it might have levers to assist in turning it, such as shown in U.S. Pat. No. 3,001,002, issued Sept. 19, 1961.

It is common in the art for the coil to be an hourglass shape which is to say that it proceeds from its open end which is large to a narrow opening or throat and then expands again toward the inner end which is seated in the cap, of the type shown generally in U.S. Pat. No. 3,075,038, issued Jan. 22, 1963. And a coil of that type which is generally known as a "free spring" coil or connector may be used herein. The interior of the cap has been stated to be smooth but it might have a special construction, for example longitudinal ribs on the interior such as shown in U.S. Pat. No. 4,227,040, issued Oct. 7, 1980. And the interlock or adhesion might take place between the ribs and the coil only, or a combination. As well the cross section through the cap may take any suitable form, i.e. an example being that disclosed in U.S. Pat. No. 4,220,811, issued Sept. 2, 1980. It has also been stated that the resulting connector is intended to be screwed down on the stripped ends of a plurality of electric wires. And it should be understood that the connector might be a so-called no strip connector meaning that all of the insulation is not removed from the ends of the wire.

For example, in U.S. Pat. No. 3,497,607, issued Feb. 24, 1970, the interior of the coil is of a construction that will cut or abrade through a certain degree of insulation on the wires to be connected. And the present invention could be used in that type of a connector.

While the preferred form and several variations of the invention have been shown, described and suggested, it should be understood that suitable additional modifications, changes, substitutions and alterations may be made without departing from the invention's fundamental theme.

The embodiments of the invention in which an exclusive property or privilege is claimed are defined as follows:

1. A method of making an electrical connector of the screw-on type which includes a shell of thermoplastic insulating material having a central bore closed at one end by an integral end wall and open at the other end and a generally tapered wire coil of a size and shape to be disposed in the central bore and arranged to receive and be turned down on stripped ends of the wires by rotation of the shell and coil relative to the wires, including the steps of disposing the shell and coil in aligned relation, the small end of the coil toward the open end of the bore of the cap, causing the coil and shell to be brought together with the coil in the bore of the shell, supplying sufficient heat to the bore of the shell to soften it and cause it to flow into an adherent relationship with the outer portions of the coil and, at the same time applying sufficient axial pressure between the coil and shell so as to cause the coil to be further inserted in the shell, and discontinuing the heating and axial pressure step when an interlock has been created between the exterior of the coil and the interior of the shell sufficient to withstand the forces involved in turning the finished connector down on the stripped ends of the wires and, at the same time, the coil and shell have been brought to a predetermined axial relation.

2. The method of claim 1 further characterized in that supplying heat includes applying sufficient ultrasonic vibrations between the shell and coil.

3. The method of claim 2 further characterized in that the ultrasonic vibrations are applied to the coil.

4. A method of making screw-on connectors which have an insulating shell with a bore open at one end and a wire coil in the bore of the shell, including the steps of inserting the coils in the shells, and thereafter simultaneously heating the coils and shells and applying an axial compressive thrust between them to force them together to a predetermined axial relation and to fuse the coils and shells together at the same time.

5. The method of claim 4 further characterized in that heating the coils includes applying ultrasonic vibrations between the coils and shells to cause the coils to become embedded in the shells.

6. The method of claim 5 further characterized in that the ultrasonic vibrations are applied to the coils.

7. A method of making screw-on electrical connectors which have an insulating shell with a bore open at one end and a coil wire in the bore of the shell, comprising feeding the coils and shells together, assembling the coils into the shells at a predetermined location, and heating the coils and shells sufficiently to soften the insulation in the bore of the shells and, at the same time, applying an axial compressive thrust between the coils and shells to force them together to a predetermined axial relation.

8. The method of claim 7 further characterized in that heating the coils and shells includes applying ultrasonic vibrations between the coils and shells to cause the coil to become embedded in the bore of the shell.

9. The method of claim 8 further characterized in that the ultrasonic vibrations are applied to the coils.

* * * * *